US006857991B2

(12) United States Patent
Yu

(10) Patent No.: US 6,857,991 B2
(45) Date of Patent: Feb. 22, 2005

(54) AUXILIARY FOLDING DEVICE FOR A TREADMILL

(75) Inventor: Te Liang Yu, Tai Ping (TW)

(73) Assignee: Alilife Industrial Co., Ltd., Taichung (TW)

( * ) Notice: Subject to any disclaimer, the term of this patent is extended or adjusted under 35 U.S.C. 154(b) by 0 days.

(21) Appl. No.: 10/720,242

(22) Filed: Nov. 25, 2003

(65) Prior Publication Data

US 2004/0176216 A1 Sep. 9, 2004

(30) Foreign Application Priority Data

Mar. 4, 2003 (TW) ..... 92203240 U

(51) Int. Cl.[7] ..... A63B 22/00
(52) U.S. Cl. ..... 482/54
(58) Field of Search ..... 482/54

(56) References Cited

U.S. PATENT DOCUMENTS 6,090,016 A * 7/2000 Kuo ..... 482/54
6,592,496 B1 * 7/2003 Tsou ..... 482/54
6,746,376 B2 * 6/2004 Chang ..... 482/54
6,758,791 B1 * 7/2004 Kuo ..... 482/54

* cited by examiner

*Primary Examiner*—Stephen R. Crow
(74) *Attorney, Agent, or Firm*—Rosenberg, Klein & Lee

(57) ABSTRACT

An auxiliary folding device for a treadmill is mounted between a main frame and the platform of the treadmill. The platform is pivotally connected to the main frame. The auxiliary folding device includes an air cylinder having opposite ends respectively pivotally connected to the main frame and the platform. The air cylinder extends when the user folds the platform toward the main frame for user to fold the treadmill in a labor-saving way.

7 Claims, 6 Drawing Sheets

AUXILIARY FOLDING DEVICE FOR A TREADMILL

BACKGROUND OF THE INVENTION

1. Field of the Invention

The present invention relates to an auxiliary folding device, and more particularly to an auxiliary folding device for a treadmill.

2. Description of Related Art

For reducing the volume of a treadmill when being stored, most of the treadmills are designed to be foldable. In folding the treadmill, a platform of the treadmill is upward turned toward the stand of the treadmill. For easily folding the treadmill and holding the turned platform in place, an air cylinder is mounted on a first side of the treadmill for easily lifting the platform and a locking device mounted on a second side of the treadmill for holding the turned platform in place.

However, the air cylinder is mounted on one side of the treadmill and the other side of the treadmill is locked by the locking device such that the air cylinder may be over loaded. The air cylinder may be broken when loading all the gravity of the treadmill for a long time. To mount two air cylinders to two opposite sides of the treadmill may solve the above problem. However, two air cylinders may greatly increase the manufacturing cost of the treadmill.

Another conventional auxiliary folding device for a treadmill in accordance with the prior art shown in FIG. 6 is mounted between a main frame (6) and a platform (7) of the treadmill for easily lifting the platform (7) toward the main frame (6). The base frame (6) has two arms (61) respectively upwardly extending from two opposite sides of the main frame (6) and the platform (7) is pivotally mounted to the main frame (6) between the two arms (61) of the main frame (6). The auxiliary device (8) includes a telescope rod (81) mounted on a first side of the treadmill and an air cylinder (82) mounted on a second side of the treadmill for easily lifting the platform of the treadmill. A locking pin (811) extends through the telescope rod (81) to lock the telescope rod (81) when the telescope rod (81) extends to a suitable length.

However, the telescope rod (81) is mounted on one side of the treadmill and locked after expanding, and the air cylinder (82) is mounted on the other side of the treadmill such that the above problem of over load of the air cylinder has not solved. As shown in FIG. 6, the telescope rod (81) and the air cylinder (82) are respectively mounted on two opposite side of the treadmill such that the manufacturing processes of mounting the auxiliary device (8) to the treadmill are complicated. Furthermore, the dust and a crash may shorten the using life of the air cylinder (82) because an inner rod (not numbered) of the air cylinder is exposed in the air after extending to lift the platform (7).

SUMMARY OF THE INVENTION

The main objective of the present invention is to provide an improved auxiliary folding device for a treadmill that the user can fold the treadmill in a labor-saving way.

To achieve the objective, the auxiliary folding device is mounted between a main frame and the platform of the treadmill. The platform is pivotally connected to the main frame. The auxiliary folding device includes an air cylinder having opposite ends respectively pivotally connected to the main frame and the platform. The air cylinder extends when the user folds the platform toward the main frame for user to fold the treadmill in a labor-saving way.

DETAILED DESCRIPTION OF THE INVENTION

Figure 1:
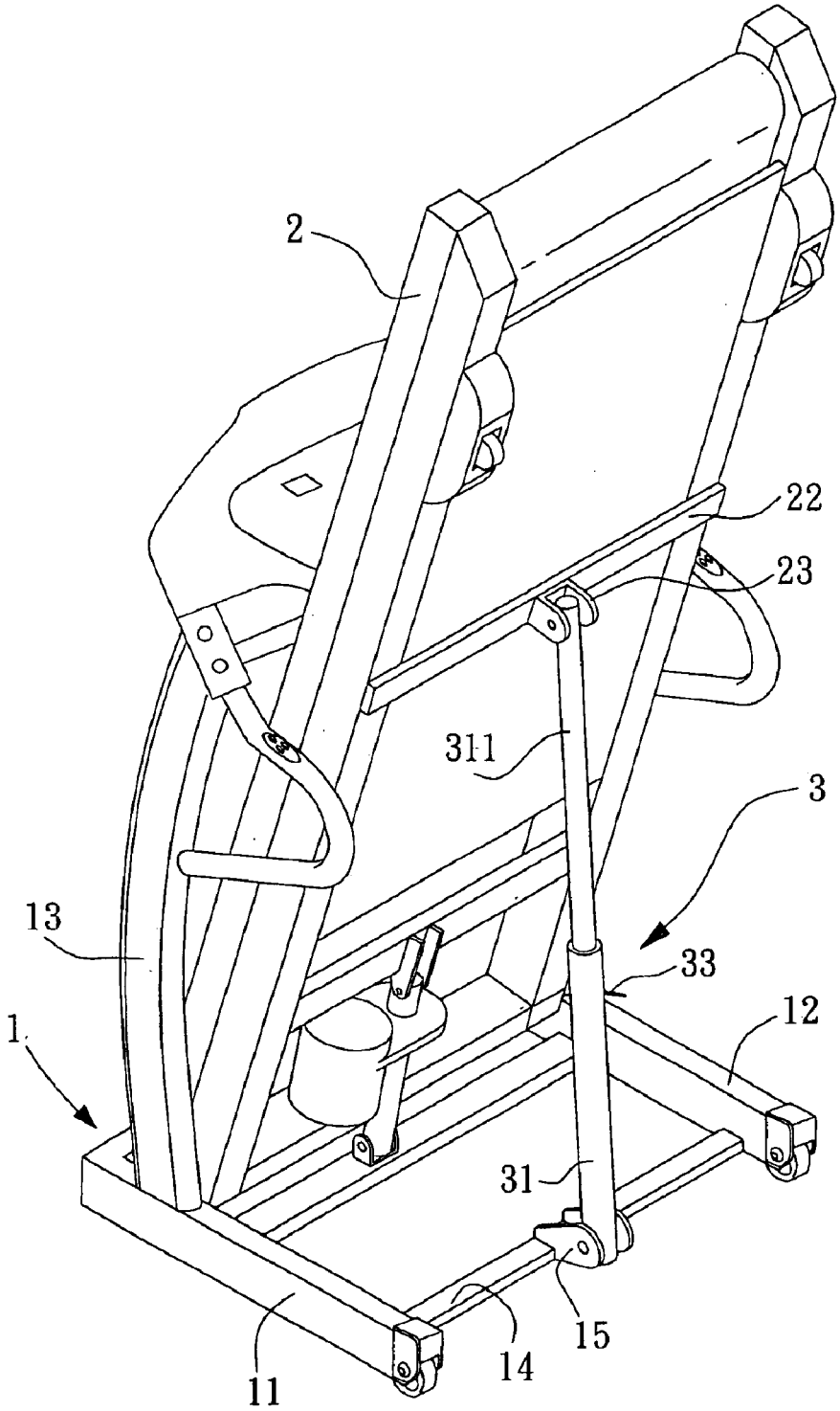
FIG. 1 is a perspective schematic view of an auxiliary folding device for a treadmill in accordance with the present invention.
Figure 2:
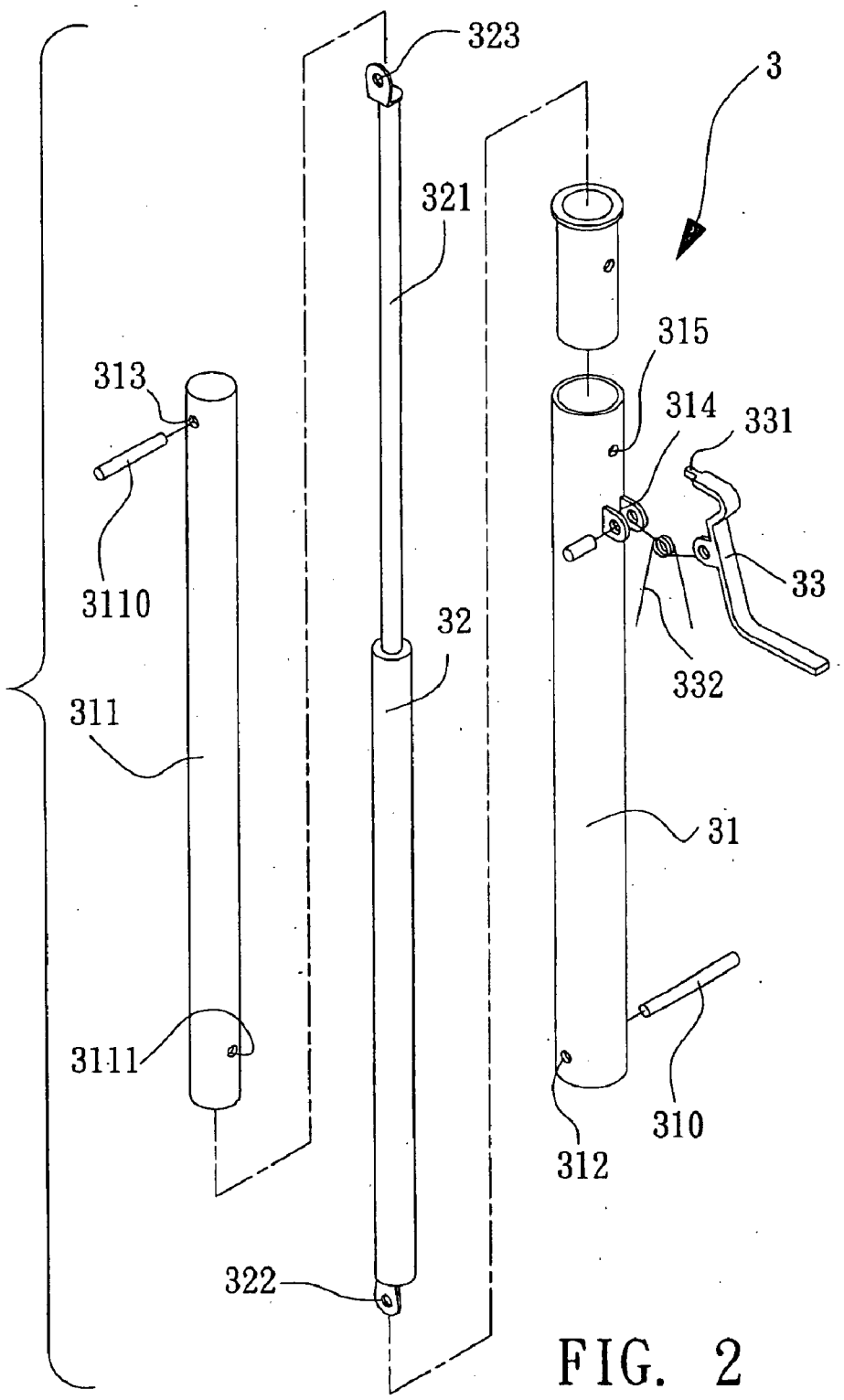
FIG. 2 is an exploded perspective view of the auxiliary folding device for a treadmill in FIG. 1.
Figure 3:
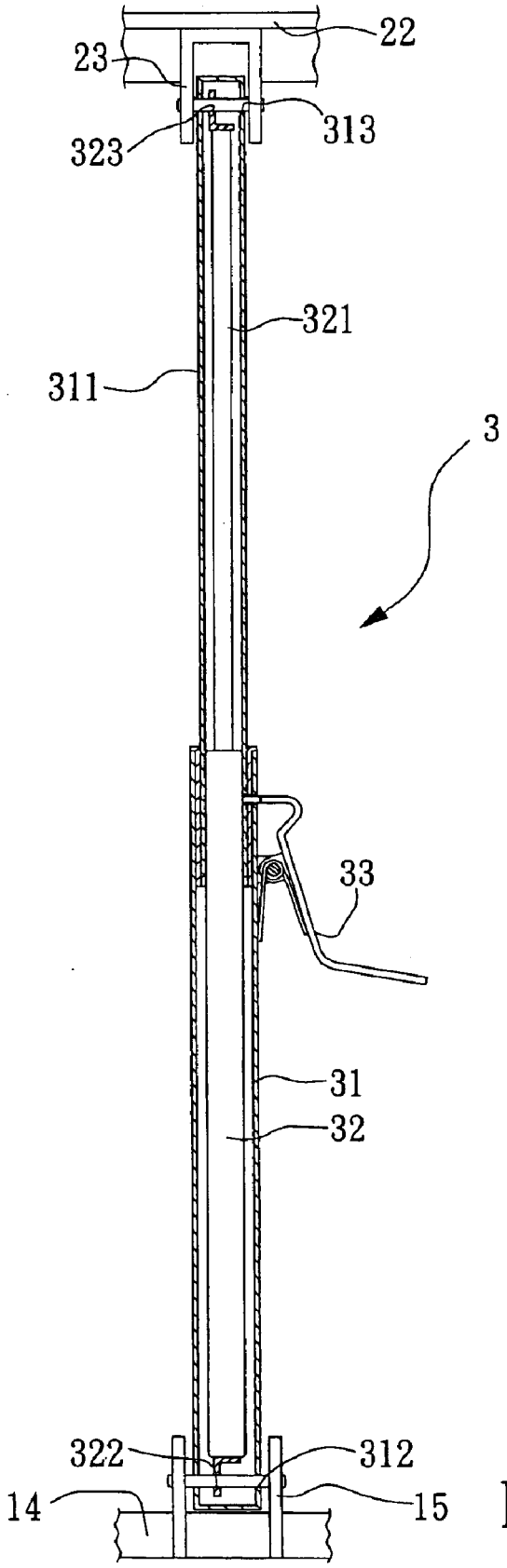
FIG. 3 is a side cross sectional view of the auxiliary folding device for a treadmill if FIG. 1.

Referring to the drawings and initially to FIGS. 1–3, an auxiliary folding device (3) for a treadmill in accordance with the present invention is adapted to be mounted between a main frame (1) and a platform (2) of the treadmill. The main frame (1) includes a first post (11) and a second post (12) opposite to each other. A first connecting rod (14) is provided to connect the first post and the second post (12) to form a U-shape. A first pivot seat (15) centrally extends from the first connecting rod (14) and a rack (13) upwardly extends from the main frame (1) opposite to the first connecting rod (14). The platform (2) is pivotally connected to the main frame (1) between the first post (11) and the second post (12). The platform (2) includes a second connecting rod (22) transversely secured on a bottom of the platform (2), and a second pivot seat (23) extending from the second connecting rod (22) and corresponding to the first pivot seat (15).

The auxiliary folding device (3) has two opposite ends respectively pivotally connected to the first pivot seat (15) and the second pivot seat (23). The auxiliary folding device (3) includes a first post (31) pivotally connected to the first pivot seat (15), a second post (32) received in the first post (31) and a locking device (33) mounted on an outer periphery of the first post (31).

A spreading post (311) is movably received in the first post (31) between the first post (31) and the second post (32). The spreading post (311) is capable to longitudinally extend from the first post (31). The second post (32) has a spreading rod (321) movably received therein. The spreading rod (321) is capable to longitudinally extend from the second post (32). The spreading post (311) is moved with the spreading rod (321). In the preferred embodiment of the present invention, the second post (32) is an air cylinder and the spreading rod (321) is the piston of the air cylinder.

The first post (31) has a first pivot hole (312) defined in a first end of the first post (31) and diametrically extending through the first post (31). The second post (32) has a first ear (322) extending from a first end of the second post (32) and corresponding to the first pivot hole (311). A first pin (not numbered) extends through the first pivot hole (312), the first ear (322) and the first pivot seat (15) such that the first post (31) and the second post (32) are pivotally connected to the first pivot seat (15). The spreading post (311) has a second pivot hole (313) defined in one end of the spreading post (311) opposite to the first pivot hole (312) and extending through the spreading post (311). The spreading rod (321) has a second ear (323) extending therefrom opposite to the first ear (322) and corresponding to the second pivot hole (313). A second pin (not numbered) extends through the second pivot seat (23), the second pivot hole (313) and the second ear (323) such that the spreading post (311) and the spreading rod (321) are pivotally connected to the second pivot seat (23).

The first post (31) has a pair of ears (314) laterally extending from an outer periphery of the first post (31) and the locking device (33) is pivotally mounted to the pair of ears (314). A stub (331) extending from the locking device (33) and is selectively inserted into the first post (31) and the spreading post (311) to hold the spreading post (311) and the spreading rod (321) in place after spreading. A resilient member (332) is mounted between the locking device (33) and the first post (31) to provide a restitution force to the locking device (33) when the stub (331) is detached from the spreading post (311) and the first post (31). In the preferred embodiment of the present invention, the resilient member (332) is a torsion spring. A hole (315) is defined in the first post (31) to allow the stub (331) inserted in to the first post (31) and the spreading post (311) has a bore (3111) defined to allow the stub (331) inserted into the spreading post (311).

Figure 4:
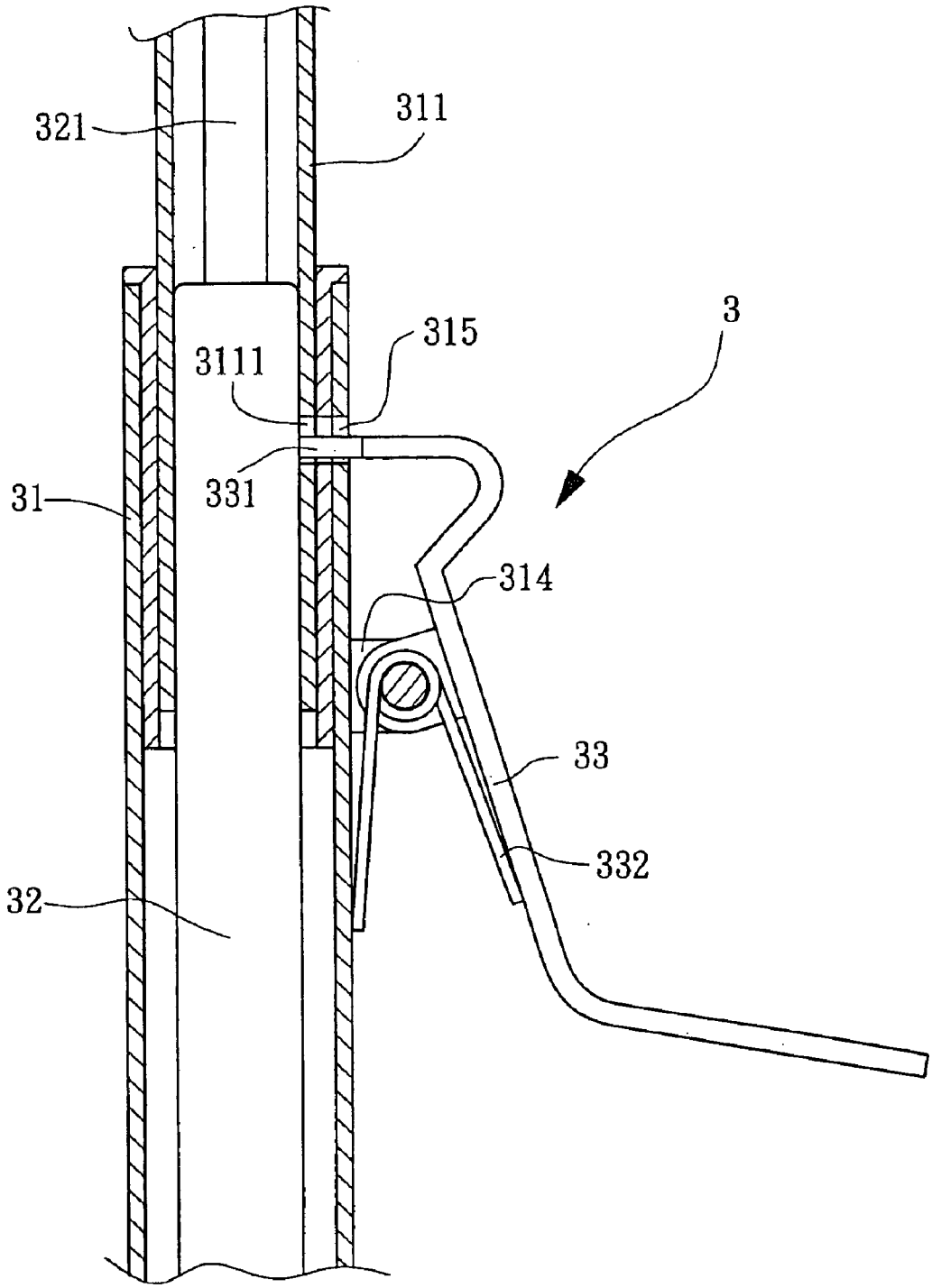
FIG. 4 is a partially side cross sectional view of the auxiliary folding device for a treadmill in FIG. 3.
Figure 5:
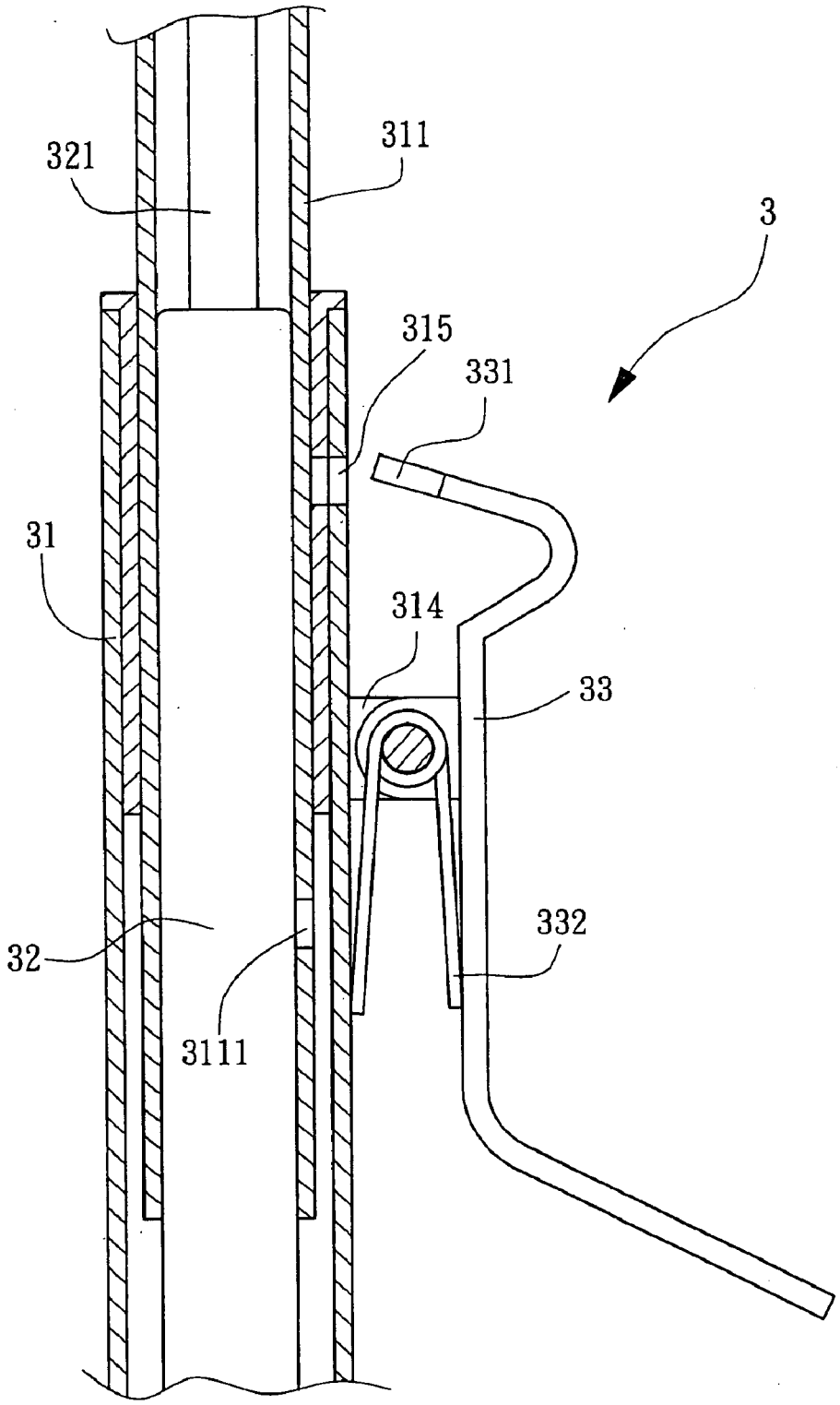
FIG. 5 is a partially side cross sectional view of the auxiliary folding device for a treadmill in FIG. 3.
Figure 6:
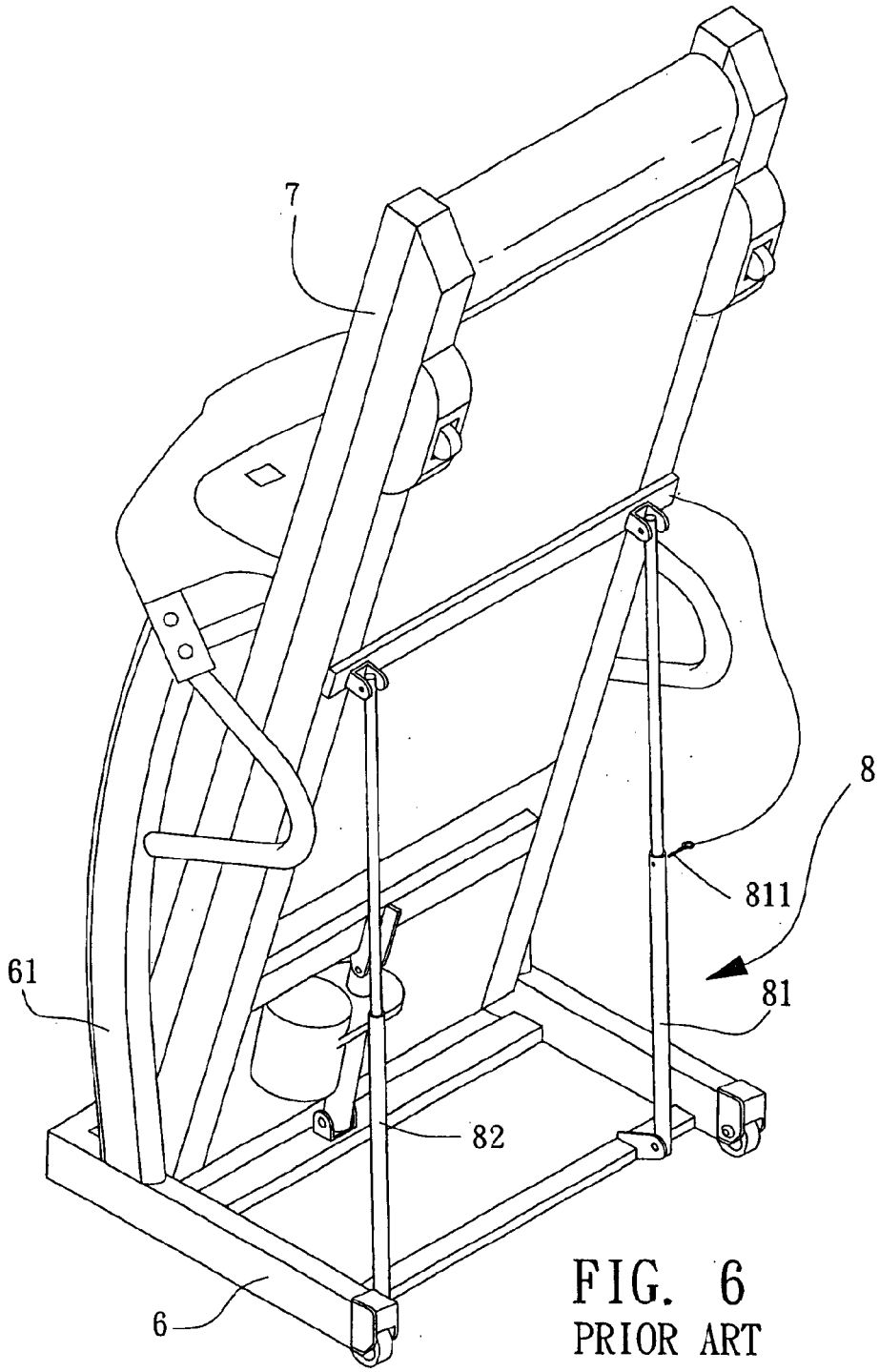
FIG. 6 PRIOR ART
FIG. 6 is a perspective schematic view of a conventional auxiliary folding device for a treadmill in accordance with the prior art.

The spreading post (311) in the first post (31) and the spreading post (321) in the second post (32) extend when the platform (2) is moved toward the main frame (1) for user to easily fold the treadmill. With reference to FIG. 4, the stub (331) is inserted into the hole (315) and the bore (3111) due to the restitution force of the resilient member (332) for holding the spreading post (311) in place when the spreading post (311) longitudinally spreads from the first post (31) and the bore (3111) communicates with the hole (315) in the first post (31). With reference to FIG. 5, the spreading rod (311) is freely moved in the first post (31) and the spreading rod (321) is freely moved in the second post (32) when the locking device (33) is wrenched toward the first post (31) and the stub (331) is escaped from the bore (3111) and the hole (315). Consequently, the platform (2) can be easily downward moved to the supporting surface for user to exercise thereon.

The first pivot hole (312) in the first post (31) and the first ear (322) of the second post (32) are pivotally mounted to each other, and the second pivot hole (313) in the spreading post (311) and the second ear (323) of the spreading rod (321) acre pivotally mounted to each other. Consequently, all the gravity of the platform (2) is loaded by first post (31), and the second post (32) and the spreading rod (321) are in a free condition to prevent the second post (32) from being broken after loading the gravity of the platform for a long time when the treadmill finishing folding. Furthermore, the first post (31) is centrally pivotally connected to the main frame (1) such that the first post (31) can provide a steadier support than that provided by the conventional telescope rod, which is mounted on one side of the main frame.

The second post (32) and the spreading rod (321) are respectively and movably received in the first post (31) and the spreading post (311). Consequently, the first post (31) and the spreading post (311) can prevent the using life of the second post and the spreading rod (321) from being shortened due to dust or a sudden crash.

What is claimed is:

1. An auxiliary folding device for a treadmill adapted to be mounted between a main frame and a platform, the main frame including a first post and a second post opposite to each other, a first connecting rod connecting the first post and the second post, a first pivot seat centrally extending from the first connecting rod and a rack upwardly extends from the main frame opposite to the first connecting rod, the platform pivotally connected to the main frame between the first post and the second post, the platform including a second connecting rod transversely secured on a bottom of the platform, and a second pivot seat extending from the second connecting rod and corresponding to the first pivot seat, the auxiliary folding device comprising:

a first post adapted to be pivotally connected to the first pivot seat, a second post received in the first post;

a spreading post movably received in the first post between the first post and the second post, the spreading post being capable to longitudinally extend from the first post, the second post having a spreading rod movably received therein, the spreading rod being capable to longitudinally extend from the second post and the spreading post moved with the spreading rod;

a locking device mounted on an outer periphery of the first post to hold the spreading post and the spreading rod in place after spreading;

the first post having a first pivot hole defined in a first end of the first post and diametrically extending through the first post, the second post having a first ear extending from a first end of the second post and corresponding to the first pivot hole, a first pin extending through the first pivot hole, the first ear and the first pivot seat such that the first post and the second post are pivotally connected to the first pivot seat; and the spreading post having a second pivot hole defined in one end of the spreading post opposite to the first pivot hole and extending through the spreading post, the spreading rod having a second ear extending therefrom opposite to the first ear and corresponding to the second pivot hole, a second pin extending through the second pivot seat, the second pivot hole and the second ear such that the spreading post and the spreading rod are pivotally connected to the second pivot seat.

2. The auxiliary folding device as claimed in claim 1, wherein:

the first post has a hole defined therein and corresponds to the locking device;

the spreading post has a bore defined in one of the spreading post opposite to the second pivot hole, the bore communicating with the hole in the first post after the spreading post spreading; and the locking device has stub extending therefrom and selective inserted into the hole in the first post and the bore in the spreading post to hold the spreading post and the spreading rod in place after spreading, and a resilient member mounted between the locking device and the first post to provide a restitution force to the locking device when the stub is detached from the spreading post and the first post.

3. The auxiliary folding device as claimed in claim 1, wherein second post is an air cylinder and the spreading rod is used as a piston of the air cylinder.

4. The auxiliary folding device as claimed in claim 2, wherein second post is an air cylinder and the spreading rod is used as a piston of the air cylinder.

5. The auxiliary folding device as claimed in claim 2, wherein the resilient member is a torsion spring.

6. The auxiliary folding device as claimed in claim 3, wherein the resilient member is a torsion spring.

7. The auxiliary folding device as claimed in claim 4, wherein the resilient member is a torsion spring.

* * * * *